US012800228B2

(12) United States Patent
Joardar

(10) Patent No.: US 12,800,228 B2
(45) Date of Patent: Nov. 17, 2026

(54) MICROCHANNEL HEAT EXCHANGER

(71) Applicant: Carrier Corporation, Palm Beach Gardens, FL (US)

(72) Inventor: Arindom Joardar, Jamesville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 123 days.

(21) Appl. No.: 18/934,935

(22) Filed: Nov. 1, 2024

(65) Prior Publication Data

US 2025/0155199 A1 May 15, 2025

Related U.S. Application Data

(60) Provisional application No. 63/597,765, filed on Nov. 10, 2023.

(51) Int. Cl.
*F28C 3/06* (2006.01)

(52) U.S. Cl.
CPC ..... *F28C 3/06* (2013.01)

(58) Field of Classification Search
CPC .... F28F 2260/02; F28F 9/0202; F28F 9/0273; F28C 3/06
USPC ..... 165/104.19
See application file for complete search history.

(56) References Cited

U.S. PATENT DOCUMENTS 5,101,890 A * 4/1992 Aoki ..... F28F 9/0212 165/110
5,228,315 A * 7/1993 Nagasaka ..... F25B 39/04 165/110
5,946,940 A * 9/1999 Inoue ..... F28F 9/02 62/509
6,430,945 B1 * 8/2002 Haussmann ..... B60H 1/3227 62/509
6,505,481 B2 * 1/2003 Neumann ..... F28D 1/05375 135/132
6,694,773 B1 * 2/2004 Snow ..... F28F 9/002 62/474
7,096,930 B2 * 8/2006 Nobuta ..... F25B 39/04 165/174
7,243,710 B2 * 7/2007 Shinhama ..... F28F 9/002 165/140
7,337,832 B2 * 3/2008 Hu ..... F28D 1/05391 165/173
8,991,479 B2 * 3/2015 Fujii ..... F28D 1/0417 165/110

(Continued)

*Primary Examiner* — Claire E Rojohn, III
(74) *Attorney, Agent, or Firm* — Andrew Goldberg

(57) ABSTRACT

The heat exchanger comprises a plurality of microchannel tubes in fluidic connection with an inlet header and an outlet header, and an external distributor that comprises an inlet port and a plurality of outlet ports, wherein a plurality of feeder pipes is configured between the outlet ports of the first distributor and positioned along a length of the inlet header to enable flow of volumes of fluid from the distributor into the inlet header. Further, an auxiliary header is fluidically coupled to the outlet header using tube stubs. The auxiliary header is configured at a distance from the outlet header with the tube stubs protruding from the outlet header and extending up to the auxiliary header forming an angle from a horizontal plane of the outlet header, wherein the auxiliary header is configured to receive and collect the fluid received in the outlet header.

20 Claims, 8 Drawing Sheets

(56) References Cited

U.S. PATENT DOCUMENTS

| | | | | |
|---|---|---|---|---|
| 9,335,077 | B2 * | 5/2016 | Hanafusa | F28F 9/02 |
| 9,464,850 | B2 * | 10/2016 | Lino | F28F 9/0253 |
| 9,752,833 | B2 * | 9/2017 | Gao | F28D 15/04 |
| 9,791,190 | B2 * | 10/2017 | Hanafusa | F28F 9/0209 |
| 10,054,376 | B2 * | 8/2018 | Higashiiue | F28F 9/0221 |
| 10,161,685 | B2 * | 12/2018 | Voorhis, Jr. | F28D 1/05391 |
| 10,330,356 | B2 * | 6/2019 | Numasawa | F25B 43/006 |
| 10,544,969 | B2 * | 1/2020 | Jindou | F28D 1/05391 |
| 10,753,656 | B2 * | 8/2020 | Taras | F28F 9/0273 |
| 10,794,634 | B2 * | 10/2020 | Wei | F28F 9/0275 |
| 10,845,124 | B2 * | 11/2020 | Sugimura | F28D 1/0443 |
| 10,852,075 | B2 * | 12/2020 | Voorhis | F25B 41/20 |
| 10,914,499 | B2 * | 2/2021 | Nakamura | F28D 1/053 |
| 11,181,305 | B2 * | 11/2021 | Satou | F25B 41/00 |
| 11,274,838 | B2 * | 3/2022 | Hirata | F28D 1/0443 |
| 11,326,787 | B2 * | 5/2022 | Miyawaki | F24F 1/28 |
| 11,421,947 | B2 * | 8/2022 | Matsui | F25B 39/04 |
| 12,259,188 | B2 * | 3/2025 | Nakata | F25B 39/00 |
| 12,359,853 | B2 * | 7/2025 | Satou | F25B 39/00 |
| 12,504,201 | B2 * | 12/2025 | Satou | F24F 1/30 |
| 12,523,434 | B2 * | 1/2026 | Hoysall | F28D 1/0443 |
| 12,674,622 | B2 * | 7/2026 | Byrne | F28B 1/06 |
| 12,704,302 | B2 * | 8/2026 | Hoysall | F25B 13/00 |
| 2008/0296005 | A1 * | 12/2008 | Taras | F28F 27/02 165/173 |
| 2009/0078399 | A1 * | 3/2009 | Makita | F28D 1/0443 165/173 |
| 2015/0101363 | A1 * | 4/2015 | Matsuda | F25B 39/04 165/174 |
| 2016/0223231 | A1 * | 8/2016 | Morimoto | F28F 1/022 |
| 2017/0241684 | A1 * | 8/2017 | Ito | F28F 9/0275 |
| 2019/0093965 | A1 * | 3/2019 | Higashiiue | F28D 1/0435 |
| 2020/0200476 | A1 * | 6/2020 | Satou | F28D 1/05383 |
| 2021/0310742 | A1 * | 10/2021 | Zhao | F24F 13/30 |
| 2022/0099388 | A1 * | 3/2022 | Huang | F28F 9/0278 |
| 2022/0120481 | A1 * | 4/2022 | Hirokawa | F25B 41/42 |
| 2022/0120504 | A1 * | 4/2022 | Yamada | F28D 1/05383 |
| 2024/0210127 | A1 * | 6/2024 | Hoysall | F28D 1/0443 |
| 2024/0418458 | A1 * | 12/2024 | Hoysall | F28D 7/16 |
| 2025/0137738 | A1 * | 5/2025 | Joardar | F25B 39/028 |
| 2025/0155199 | A1 * | 5/2025 | Joardar | F28D 1/0426 |
| 2025/0264283 | A1 * | 8/2025 | Mohanta | F28F 13/003 |
| 2025/0283673 | A1 * | 9/2025 | Joardar | F28F 9/0278 |
| 2026/0202089 | A1 * | 7/2026 | Taras | F24F 13/30 |

* cited by examiner

MICROCHANNEL HEAT EXCHANGER

CROSS-REFERENCE TO RELATED APPLICATION

This patent application claims the benefit of U.S. Provisional Patent Application No. 63/597,765, filed on Nov. 10, 2023, which is incorporated by reference herein in its entirety.

BACKGROUND

This invention relates to a microchannel heat exchanger.

SUMMARY

Described herein is a heat exchanger. The heat exchanger a plurality of microchannel tubes extending between and in fluidic connection with an inlet header and an outlet header of the heat exchanger, an external distributor that comprises an inlet port and a plurality of outlet ports, wherein a plurality of feeder pipes is configured between the outlet ports of the first distributor and positioned along a length of the inlet header to enable flow of volumes of fluid from the external distributor into the inlet header, and an auxiliary header fluidically coupled to the outlet header using one or more tube stubs, the auxiliary header configured at a distance from the outlet header with the one or more tube stubs protruding from the outlet header and extending up to the auxiliary header forming an angle from a horizontal plane of the outlet header, wherein the auxiliary header is configured to receive and collect the fluid received in the outlet header.

In one or more embodiments, the inlet header and the outlet header are positioned at same vertical height and the plurality of microchannel tubes includes a bend forming a V-coil configuration having a first leg on a first side of the bend and a second leg on a second side of the bend, wherein the first leg and the second leg define a mixing area therebetween for mixing of an incoming airflow coming from a bottom side of the plurality of microchannel tubes.

In one or more embodiments, the inlet header and the outlet header are positioned at different height and the plurality of microchannel tubes includes a bend forming a V-coil configuration having a first leg on a first side of the bend and a second leg on a second side of the bend, wherein the first leg and the second leg have different lengths and define a mixing area therebetween for mixing of an incoming airflow coming from a bottom side of the plurality of microchannel tubes.

In one or more embodiments, the inlet header is a hollow member having one or more first compartments separated by one or more first walls, wherein the plurality of feeder pipes is configured between the outlet ports of the first distributor and the first compartments of the inlet header, such that each of the first compartments remains fluidically connected to at least one of the outlet ports of the external distributor by at least one of the feeder pipes to enable flow of the volumes of fluid from the external distributor into the one or more first compartments.

In one or more embodiments, the outlet header is a hollow member having one or more second compartments separated by one or more second walls, wherein a first end of each of the tube stubs is fluidically connected to at least one of the second compartments of the outlet header and a second end of the corresponding tube is fluidically connected the auxiliary header.

In one or more embodiments, the outlet ports of the first distributor are non-uniform in size such that the volumes of the fluid are provided in the first compartments of the inlet header.

In one or more embodiments, the feeder pipes have non-uniform diameters and lengths such that a target pressure drop is achieved in the feeder pipes and the volumes of the fluid are supplied in the first compartments of the inlet header.

In one or more embodiments, diameters and lengths of the feeder pipes connected to the one or more first compartments decrease while moving from extreme ends of the inlet header towards a middle portion of the inlet header.

In one or more embodiments, the feeder pipes associated with each of the first compartments are fluidically connected to the corresponding first compartment, such that the fluid received from the external distributor impinges on an interior surface of the corresponding first compartment which is in thermal contact with an incoming airflow upstream of the plurality of microchannel tubes.

In one or more embodiments, an outlet end of the feeder pipes being fluidically connected to the inlet header comprises an orifice of a shape to create and supply a homogenous mixture of the fluid into the first compartments of the inlet header.

In one or more embodiments, the auxiliary header is oriented parallel to the outlet header, wherein each of the tube stubs is a hollow member whose longitudinal axis is oriented perpendicular to a longitudinal axis of the outlet header, such the plurality of tube stubs remains parallel to each other with a gap therebetween.

In one or more embodiments, the one or more tube stubs have a varying diameter along a longitudinal axis of the first header.

In one or more embodiments, diameters of the one or more tube stubs connected to the one or more second compartments increase while moving from extreme ends of the outlet header towards a middle portion of the outlet header.

In one or more embodiments, the auxiliary header is at the distance from the outlet header, such that the auxiliary header remains away from the air flowing downstream of the plurality of microchannel tubes.

In one or more embodiments, the auxiliary header is at the distance from the outlet header such that the auxiliary header remains in thermal contact with a warm or hot airflow.

In one or more embodiments, the auxiliary header is configured such that the plurality of microchannel tubes remains on one side of the outlet header and the auxiliary header remains on another side of the outlet header away from the air flowing downstream of the plurality of microchannel tubes.

Also described herein is a heat exchanger. The heat exchanger comprises a heat exchange section comprising a plurality of microchannel tubes extending between and in fluidic connection with an inlet header and an outlet header of the heat exchanger, and a bend formed in the plurality of microchannel tubes defining a first leg of the heat exchange section disposed at a first side of the bend, and a second leg of the heat exchange section disposed at a second side of the bend opposite the first side, wherein the heat exchange section is positioned relative to a flow direction of an incoming airflow such that the bend is closer to a source of the incoming airflow than the first leg and the second leg, wherein the first leg and the second leg define a mixing area therebetween for mixing of the airflow. The heat exchanger further comprises an external distributor that comprises an inlet port and a plurality of outlet ports, wherein a plurality of feeder pipes is configured between the outlet ports of the first distributor and positioned along a length of the inlet header to enable flow of volumes of fluid from the external distributor into the inlet header, and an auxiliary header fluidically coupled to the outlet header using one or more tube stubs, the auxiliary header configured at a distance from the outlet header with the one or more tube stubs protruding from the outlet header and extending up to the auxiliary header making an angle from a horizontal plane of the outlet header, wherein the auxiliary header is configured to receive and collect the fluid received in the outlet header.

The foregoing summary is illustrative only and is not intended to be in any way limiting. In addition to the illustrative aspects, embodiments, and features described above, further aspects, embodiments, features, and techniques of the subject disclosure will become more apparent from the following description taken in conjunction with the drawings.

BRIEF DESCRIPTION OF THE DRAWINGS

The accompanying drawings are included to provide a further understanding of the subject disclosure and are incorporated in and constitute a part of this specification. The drawings illustrate exemplary embodiments of the subject disclosure and, together with the description, serve to explain the principles of the subject disclosure.

In the drawings, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

Figure 1A:
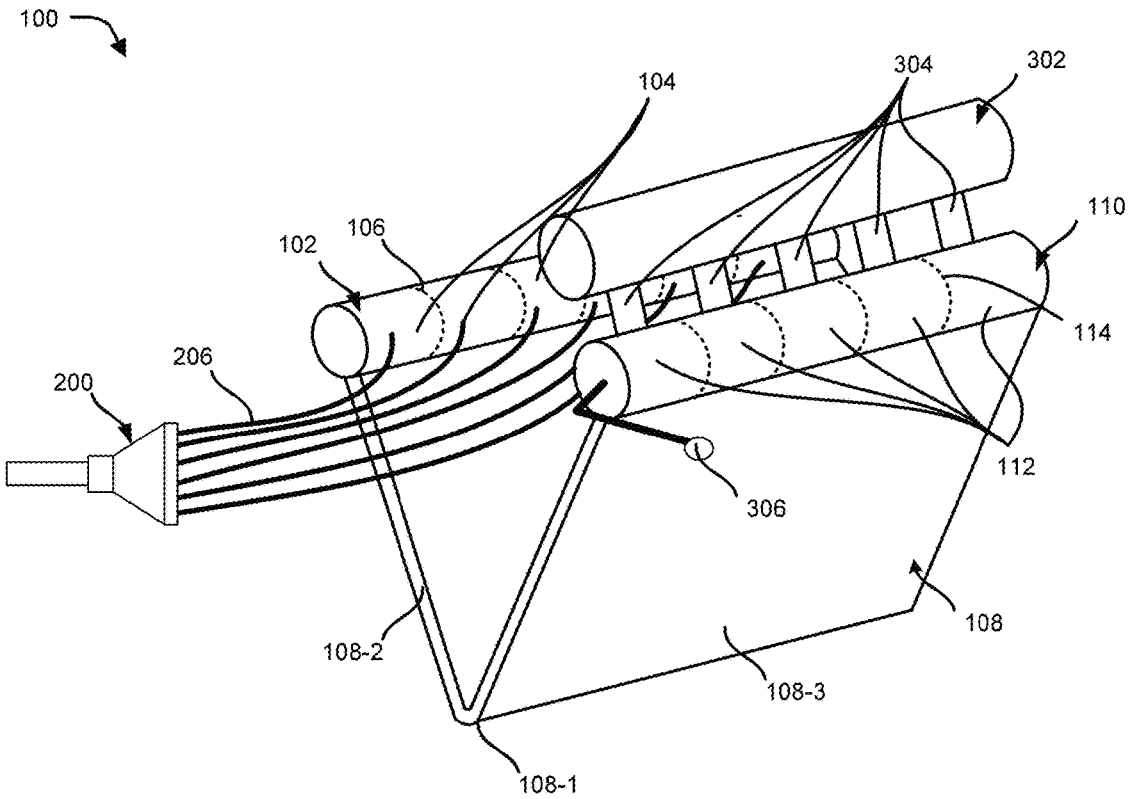
FIGS. 1A to 1C illustrate exemplary perspective views of the heat exchanger in accordance with one or more embodiments of the subject disclosure.

The following is a detailed description of embodiments depicted in the accompanying drawings. The embodiments are in such detail as to clearly communicate the disclosure. However, the amount of detail offered is not intended to limit the anticipated variations of embodiments on the contrary, the intention is to cover all modifications, equivalents, and alternatives falling within the spirit and scope of the subject disclosure as defined by the appended claims.

Various terms are used herein. To the extent a term used in a claim is not defined below, it should be given the broadest definition persons in the pertinent art have given that term as reflected in printed publications and issued patents at the time of filing.

In the specification, reference may be made to the spatial relationships between various components and to the spatial orientation of various aspects of components as the devices are depicted in the attached drawings. However, as will be recognized by those skilled in the art after a complete reading of the subject disclosure, the components of this invention. described herein may be positioned in any desired orientation. Thus, the use of terms such as "above," "below," "upper," "lower," "first", "second" or other like terms to describe a spatial relationship between various components or to describe the spatial orientation of aspects of such components should be understood to describe a relative relationship between the components or a spatial orientation of aspects of such components, respectively, as the inlet header, outlet header, distributor, multichannel tubes, heat exchanger, feeder pipes, auxiliary header and corresponding components, described herein may be oriented in any desired direction.

Referring to FIGS. 1A to 1G, the heat exchanger 100 can include an inlet header 102 which may comprise one or more hollow compartments 104 (collectively designated as first compartments 104, herein) separated by one or more first walls 106 (collectively referred to as first walls or first partition walls 106, herein). In addition, the heat exchanger can further include an outlet header 110, which may or may not include partitioned compartments 112. Further, the heat exchanger 100 can include a heat exchange section comprising a plurality of microchannel tubes 108 (collectively designated as MCHX tubes 108, herein) extending between and fluidically connecting the inlet header 102 and the outlet header 110. Furthermore, the heat exchange section of the heat exchanger 100 can include a plurality of heat-dissipating fins (not shown) in thermal contact with the tubes 108 to increase the exchange/transfer area of the tubes 108 and correspondingly enhance the heat exchange. In one or more embodiments, the heat exchanger 100 can be associated with one or more of a heating, ventilation, air-conditioning, and cooling (HVAC) system, and a transport refrigeration unit, but is not limited to the like.

In one or more embodiments, the inlet header 102 and the outlet header 110 may be configured in a horizontal orientation, with the tubes 108 extending between the inlet header 102 and the outlet header 110 in a V-coil configuration. However, the tubes 108 may also be in any downward fluid flow configuration. In one or more embodiments, the tubes 108 can include a bend 108-1 along their length. Although the heat exchanger 100 can be formed into a V-shape as illustrated, including a bend allows for additional shapes. For example, with a bend in the tubes 108, the outlet header 110 can be disposed along the same side and/or near the inlet header 102, such as in a V-shaped, U-shaped, A-shaped, or like configuration. The section of the heat exchanger 100 within the bent region 108-1, and adjacent thereto, can be free of heat-dissipating fins to allow for twisting of the tubes 108 of the heat exchange section within, and adjacent to, the bent region.

In one or more embodiments, the heat exchanger 100 in the V-shaped configuration can have the inlet header 102 positioned at the same vertical height as the outlet header 110 and the microchannel tubes 108 including the bend

Figure 1B:
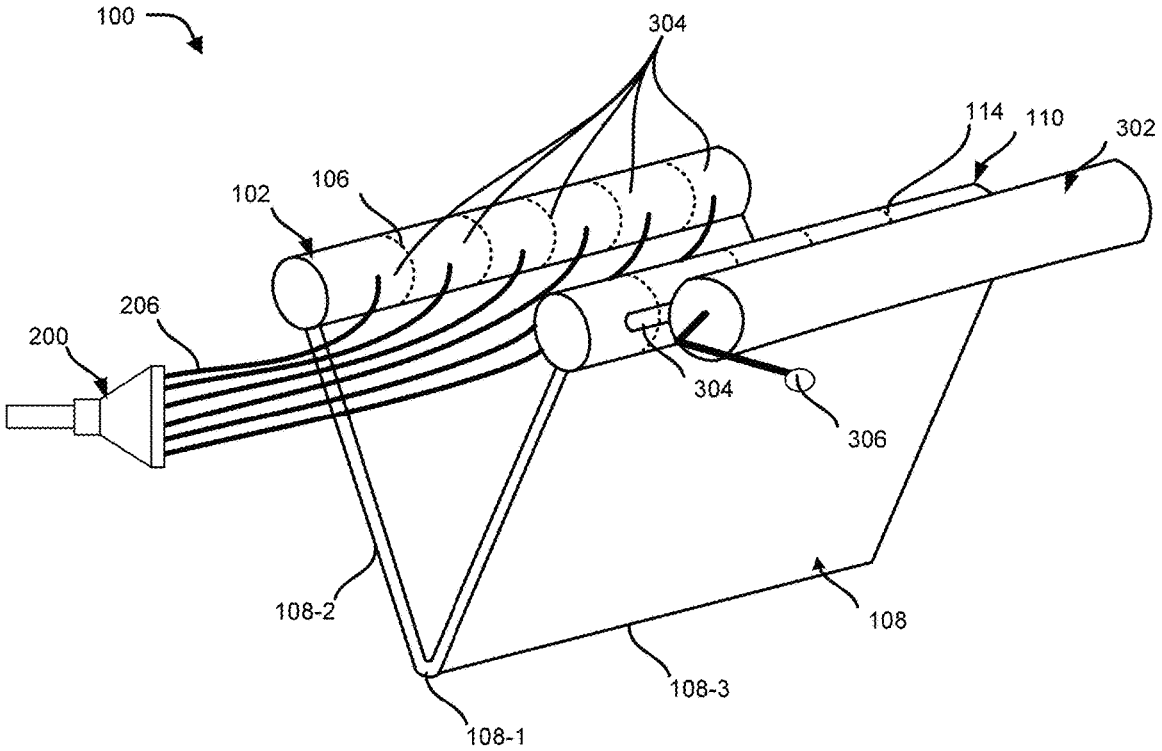

108-1 in a middle or substantially middle portion of the microchannel tubes 108. In this configuration, the tubes 108 (first leg 108-2 of the tubes 108) 108 can protrude from the inlet header 102 making an acute angle from the plane of the first header 102 in a downward direction and further (second leg 108-3 of the tubes 108) extending in an upward direction at the same acute angle into the outlet header 110, such that the V-coil arrangement of the tubes 108 having a bend 108-1 at bottom mid-point of the tubes 108 is formed with the first leg 108-2 of the tubes 108 on a first side of the bend 108-1 and the second leg 108-3 of the tubes 108 on a second side of the bend 108-1. The bend 108-1 at the bottom of tubes 108 can result in the formation of an apex at the approximate midpoint of the V-shaped tubes 108. The heat exchange section can be positioned relative to the flow direction of an incoming airflow AFU such that the bend 108-1 is closer to a source of the incoming airflow AFU than the first leg 108-2 and the second leg 108-3, where the first leg 108-2 and the second leg 108-3 can define a mixing area therebetween for mixing of the airflow. However, in other embodiments, as shown in FIG. 1H, the inlet header 102 and the outlet header 110 may also be positioned at different vertical heights or elevations, where the first leg 108-2 and the second leg 108-3 may be of different lengths.

In one or more embodiments, the heat exchanger 100 can be secured in a housing (not shown) such that the bend 108-1 is located vertically lower than the inlet header 102 and the outlet header 110, with the incoming air AFU flowing from the bottom side of the housing towards the upper side of the housing while flowing across the first leg 108-2 and second leg 108-3 of the tubes 108 and further into the mixing area therebetween. Accordingly, as the incoming airflow AFU passes through the heat exchanger 100 from the bottom side of the housing, it proceeds between the first leg 108-2 and the second leg 108-3 as cold discharge air AFD and gets mixed in the mixing area between the first and second legs 108-2, 108-3. The mixed cold discharge air AFD further flows out of the heat exchanger 100, into an area of interest to be conditioned, through the upper side of the housing.

Figure 1C:
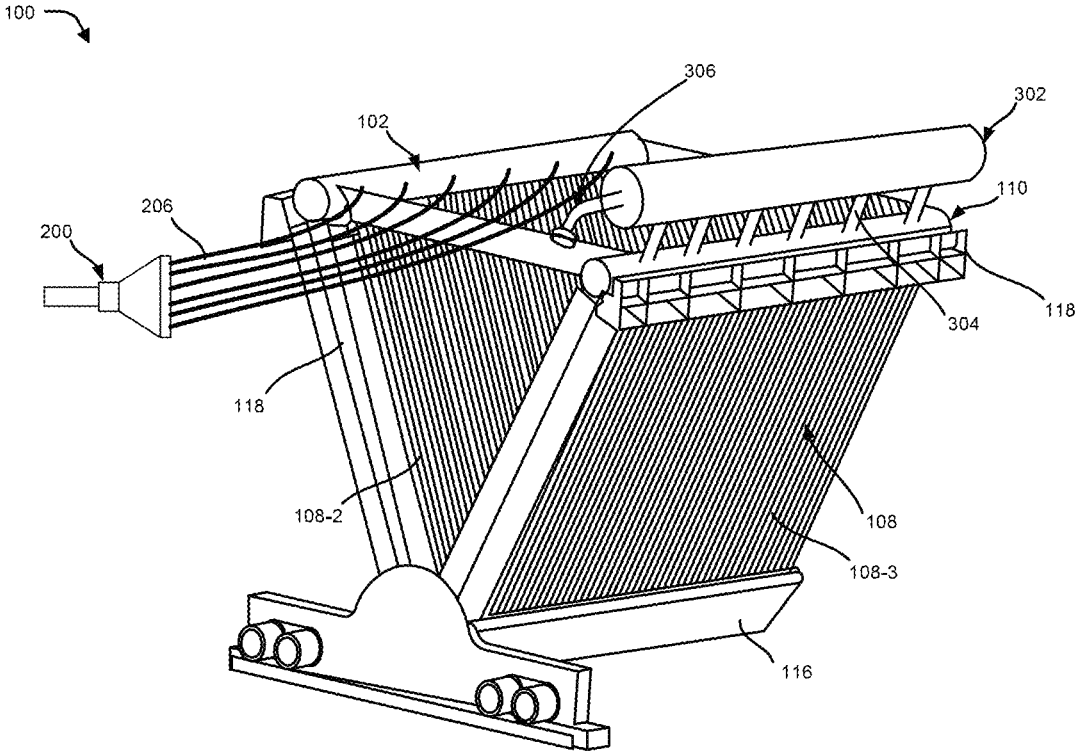

The heat exchanger 100 may be secured in the housing via the inlet header 102 and the outlet header 110 100 and/or using support structures 118 as shown in FIG. 1C. Further, a drain pan 116 can be located vertically below the bend 108-1 to capture condensation from the heat exchange section and fins. The V-arrangement of the heat exchanger 100 facilitates the condensation to run down the first leg 108-2 and the second leg 108-3 toward the bend 108-1, where the condensation falls from the bend.

In one or more embodiments, the heat exchanger 100 can include an external fluid distributor 200 (also referred to as first distributor, herein) comprising an inlet port 202 and a plurality of outlet ports 204 (shown in FIGS. 2A and 2B), where the inlet port 202 of the first distributor 200 can be fluidically connected to an expansion valve (EV) associated with the heat exchanger 100 to receive a fluid (two-phase refrigerant). Further, the heat exchanger assembly 100 can include a plurality of feeder pipes 206 (collectively referred to as feeder pipe 206, herein) configured between the first compartments 104 of the inlet header 102 and the outlet ports 204 of the first distributor 200, such that each of the first compartments 104 remains fluidically connected to at least one of the outlet ports 204 of the first distributor 200 by at least one of the feeder pipes 206 to allow the flow of predefined volumes of fluid (two-phase refrigerant supplied by the expansion valve EV) from the first distributor 200 into the first compartments 104.

In one or more embodiments, the first distributor 200 can include a housing of a shape that can include the inlet port 202 at the first end of the housing and the plurality of outlet ports at the second end of the housing. Further, the inlet port 202 can be in fluidic communication with the plurality of outlet ports 204 via a plurality of fluidic passages extending within the housing.

In one or more embodiments, the outlet ports 204 of the first distributor 200 can be non-uniform in size such that different volumes of fluid can be provided in different first compartments 104 of the inlet header 102. This may overcome the effect of air flow maldistribution on the heat exchanger involving a fan, where the location of the fan or orientation of the fan with respect to the heat exchanger may cause the air flow maldistribution.

Figure 2A:
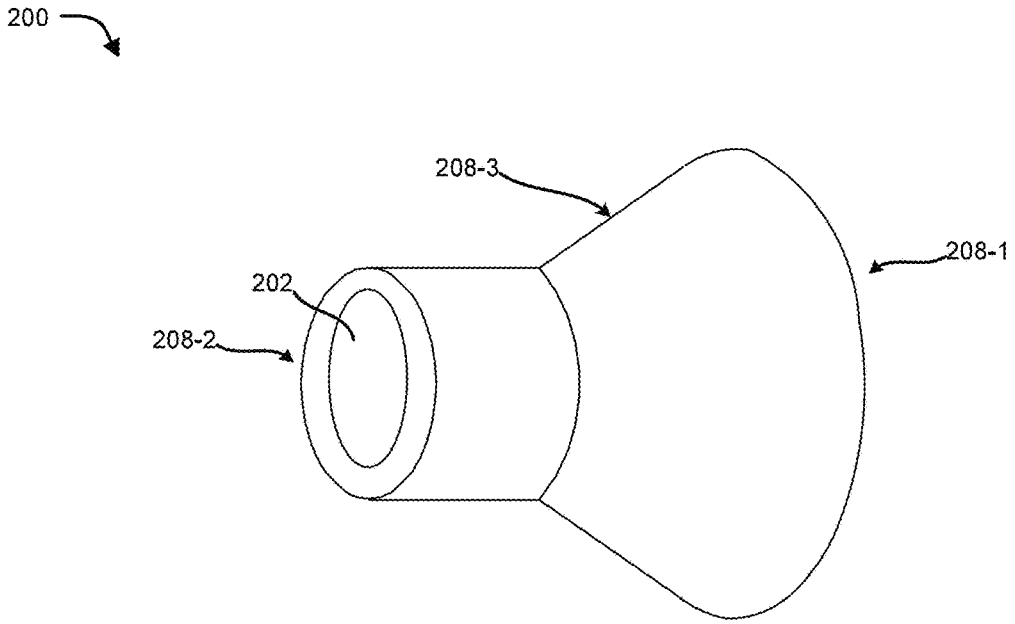
FIGS. 2A and 2B illustrate exemplary views of the external distributor of the heat exchanger in accordance with one or more embodiments of the subject disclosure
Figure 2B:
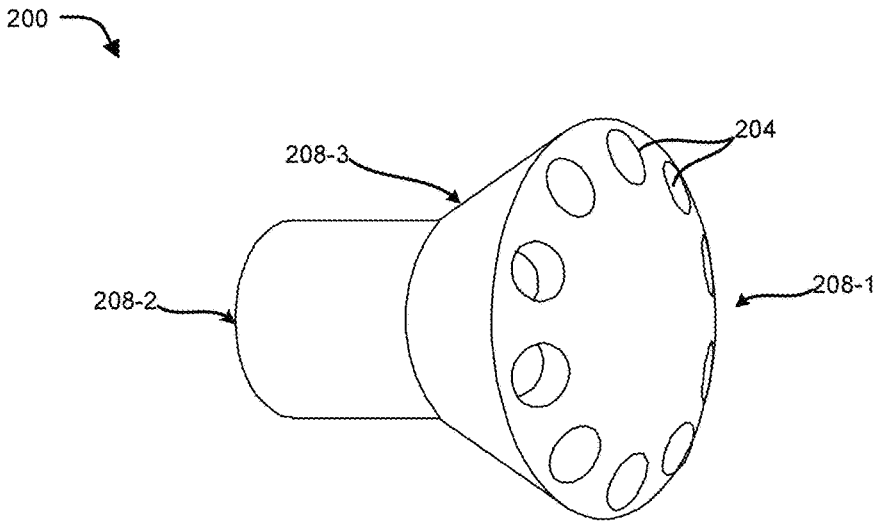

Referring to FIGS. 2A and 2B, in one or more embodiments, the first distributor 200 can have a solid conical shape that can include a substantially circular base 208-1, and a curved lateral surface 208-3 extending from a vortex end 208-1 of the first distributor 200 to the circular base 208-1. The conical distributor 200 can include the inlet port 202 at the vortex end 208-2, and the plurality of outlet ports 204 being configured circumferentially around the circular base 208-1 and in fluidic communication with the inlet port via a plurality of fluidic passages to form a shower-head type construction.

Further, the feeder pipes 206 can extend from the outlet ports 204 at the base 208-1 of the conical header 200 and can be further fluidically connected to the first compartments 104 of the inlet header 102 as shown in FIGS. 1A to 1C. In one or more embodiments, the diameter and length of the feeder pipes 206 can be non-uniform having diameters and lengths such that a target pressure drop is achieved in the feeder pipes 206. In one or more embodiments, the diameters and lengths can be selected such that a target pressure drop is achieved in the feeder pipes 206 and the volumes of the fluid are supplied in the first compartments of the inlet header 102. In one or more embodiments, the diameters and lengths of the feeder pipes 206 connected to the first compartments 104 can decrease while moving from extreme ends of the inlet header 102 towards a middle portion of the inlet header 102. This may overcome the effect of air flow maldistribution on the tubes 108 (on the first leg side 108-2), where the location of the fan or orientation of the fan with respect to the heat exchanger may cause the airflow maldistribution. Accordingly, the reduced diameter and length of the feeder pipes 206 connected to the middle portion of the inlet header 102 can allow the middle portion of the inlet header 102 as well the tubes 108 (on the first leg side) 108 associated with the middle portion to receive more volume of fluid compared to the tubes 108 on extreme ends of the inlet header 102, thereby mitigating the effect of airflow maldistribution on the first leg 108-2 or the heat exchange section.

Figure 4:
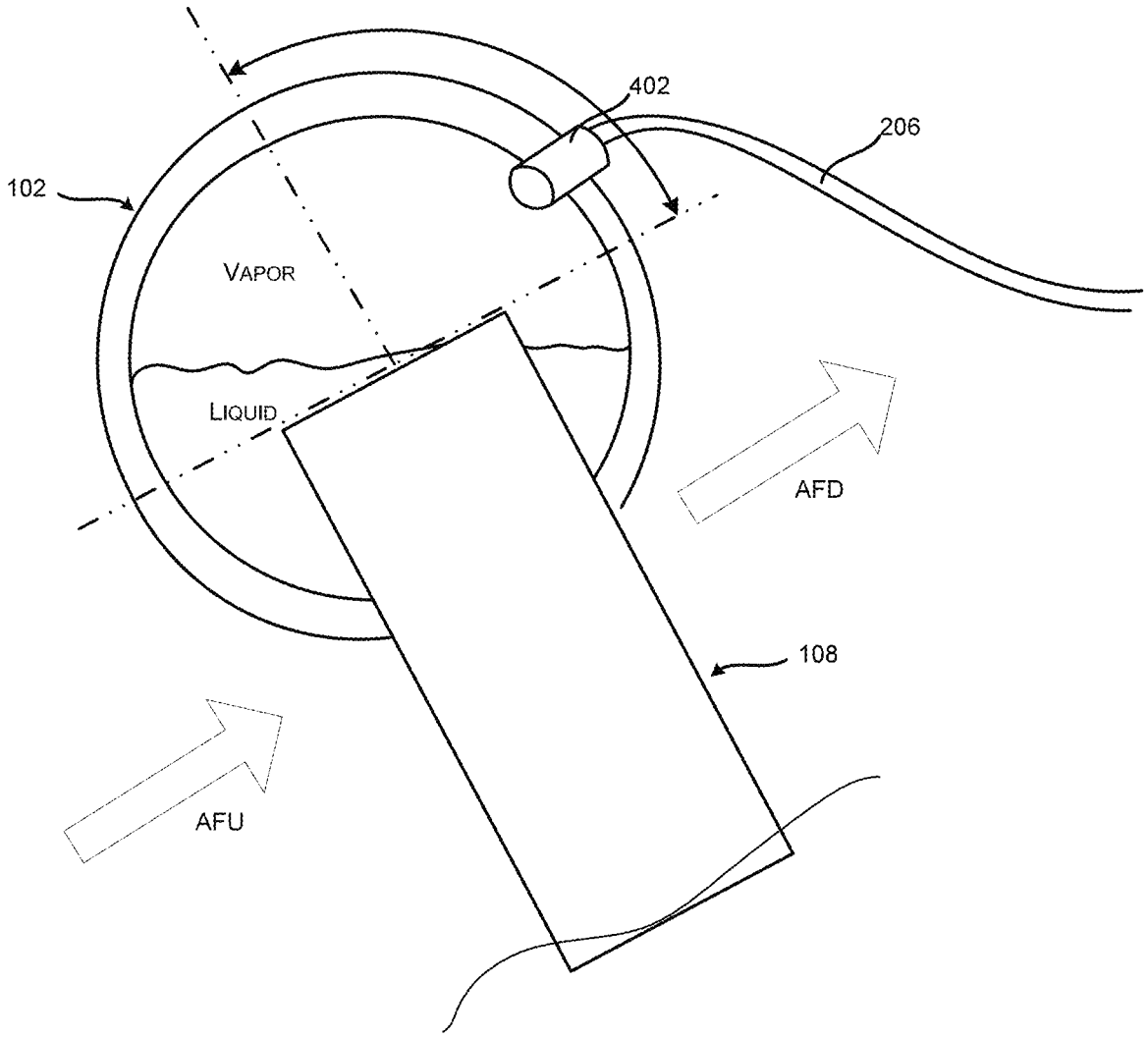
FIG. 4 illustrates an exemplary cross-sectional view of the inlet header of the heat exchanger in accordance with one or more embodiments of the subject disclosure.

In one or more embodiments, as shown in FIG. 4, the feeder pipes 206 associated with each of the first compartments 104 or inlet header 102 can be fluidically connected to the corresponding first compartment, such that the fluid received from the external distributor 200 impinges on an interior surface of the corresponding first compartment or inlet header 102 which is in thermal contact with an incoming airflow upstream AFU of the plurality of microchannel tubes 108. Accordingly, the feeder pipes 206 can supply more fluid (refrigerant) to the inlet ports of the tubes 108 (on the inlet header side) 108 which are upstream of the incoming airflow AFU, thereby mitigating the effect of airflow maldistribution on the first leg or the heat exchange section.

In addition, the outlet end of the feeder pipes 206 being fluidically connected to (or extending within) the inlet header can include an orifice 402 of a predefined shape to create and supply a homogenous mixture of the fluid into the first compartments 104 of the inlet header 102.

It should be obvious to a person skilled in the art that while various embodiments of this subject disclosure have been elaborated for the distributor 200 having a conical shape or shower-head type construction, however, the teachings of this subject disclosure are equally applicable for the distributor 200 having a different shape or types as far as the outlet ports of the first distributor 200 are connected to each first compartment 104 of the inlet header 102 via the feeder pipes 206 to supply an equal volume of the fluid comprising of liquid-vapor mixture from the expansion valve into the first compartments 104, and all such embodiments are well within the scope of this subject disclosure.

Accordingly, the fluid (two-phase refrigerant) supplied by the expansion valve EV can be received by the distributor 200 at the inlet port 202 and the outlet ports 204 can further meter equal or different volumes of the fluid into each of the first compartments 104 of the inlet header 102. In addition, the smaller volume of the first compartments 104 (compared to an inlet header of the same size and without any partition walls) can allow the fluid (received from the first distributor 200 via the feeder pipes 206) to be uniformly mixed and evenly distributed into the ports of the microchannel tubes 108 associated with the corresponding compartment 104. Additionally, an internal flow mixer or distribution device can be also present in the inlet header 102. Thus, the heat exchanger 100 can achieve a more uniform distribution of the fluid across all the microchannel tubes 108, thereby enhancing the overall thermal performance of the heat exchanger 100.

In one or more embodiments, the outlet header 110 can also include one or more hollow compartments 112 (collectively designated as second compartments 112, herein) separated by one or more second walls 114 (collectively referred to as second walls or partition walls 114, herein). The inlet header 102 and the outlet header 110 can be hollow members having parallelly placed walls separated by a distance to create the compartments therewithin. In one or more embodiments, the inlet header 102 and the outlet header 110 may have a cylindrical profile or a substantially curved profile with flat bases at the two opposite ends but are not limited to the like.

In one or more embodiments, the first compartments 104 and/or the second compartments 112 may have equal volumes, or the volumes may vary. When the compartment volumes vary the number of microchannel tubes 108 associated with the corresponding compartments 104, 112 may vary as well.

In addition, in one or more embodiments, the heat exchanger 100 can include an auxiliary header 302 (also referred to as fluid collector tube 302, herein) fluidically coupled to the outlet header 110 using one or more tube stubs 304 (collectively referred to as tube stubs 304, herein). The auxiliary header 302 can be configured to receive and collect the fluid received in the outlet header 110 via the tubes 108. The auxiliary header 302 can be adapted to be fluidically coupled to the outlet header 110 of the heat exchanger 100 using the tube stubs 304 such that the auxiliary header 302 remains configured at a distance from the outlet header 110 with the tube stubs 304 configured parallelly to each other and separated by a gap therebetween. In some embodiments, the auxiliary header 302 and tube stubs 304 may be removably coupled to the outlet header 110 of the heat exchanger 100, however, the auxiliary header 302 and tube stubs 304 may also be an integral part of the heat exchanger 100.

The auxiliary header 302 may overcome the effect of maldistribution/imbalance of the pressure field in the outlet header 110 and maldistribution of fluid in the heat exchange section, where collection of the fluid from one end of the outlet header 110 may cause the pressure field maldistribution along the length of the outlet header 110, leading to flow of different volume of fluid through the microchannel tubes 108 and further into the outlet header 110. For instance, the tubes 108 in the outlet header 110 which are close to the discharge end (one of the extreme ends) of the outlet header 110 may have more negative pressure compared to the rest of the tubes 108 in the outlet header 110. As a result, the tubes 108 close to the discharge end may draw more fluid compared to the rest of the tubes 108, thereby creating maldistribution of fluid flow across the tubes 108 in the heat exchange section. However, as the auxiliary header 302 receives equal volume of the fluid from the entire length of the outlet header 110 via the tube stubs 304, a uniform pressure field is created in the outlet header 110. As a result, an equal volume of fluid flows through the tubes 108 and further into the outlet header 110, thereby mitigating the maldistribution/imbalance of the pressure field in the outlet header 110 and the maldistribution of fluid in the heat exchange section.

Figure 1D:
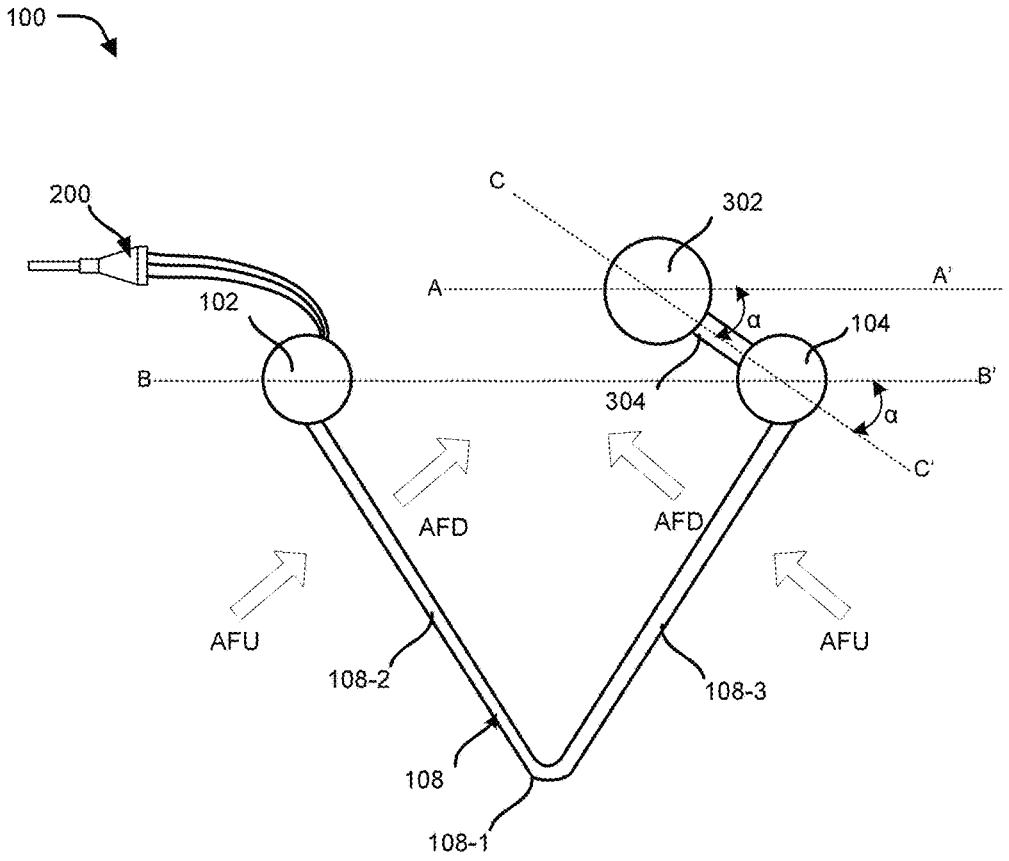
FIGS. 1D to 1G illustrates an exemplary view of the front side of the heat exchanger having the auxiliary header in different orientations in accordance with one or more embodiments of the subject disclosure.
Figure 1E:
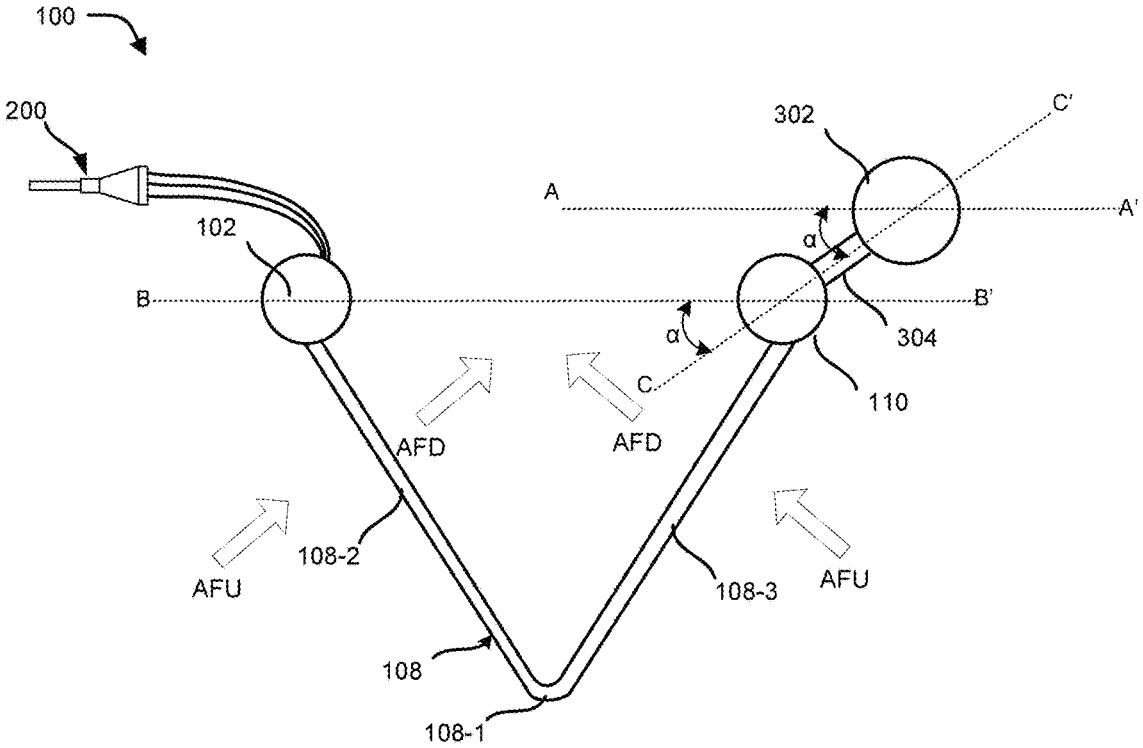

In one or more embodiments, the auxiliary header 302 may be configured parallel to the outlet header 110 and at a height above (from the horizontal plane of) the outlet header 110 such that the longitudinal axis, as well as the horizontal plane of the auxiliary header 302 and the outlet header 110, remain parallel. As illustrated in FIGS. 1D and 1E, the tube stubs 304 may protrude from the auxiliary header 302 (along axis C-C') and extend up to the outlet header 110 forming an angle ($\alpha$) from the horizontal plane (along axis A-A' or B-B') of the auxiliary header 302 and the outlet header 110 in a downward direction.

In one or more embodiments (not shown), the auxiliary header 302 and the outlet header 110 may be at the same elevation such that the auxiliary header 302 and the outlet header 110 remain in the same horizontal plane, however, the longitudinal axis of the auxiliary header 302 and the outlet header 110 may remain parallel or nonparallel to each other. Further, in other embodiments, the auxiliary header 302 may be configured parallel to the outlet header 110 and at a height below the horizontal plane of the outlet header 110 without any limitation. As illustrated in FIG. 1G, the auxiliary header 302 may be below the outlet header 110 with the tube stubs 304 protruding from the auxiliary header 302 (along axis C-C') and extending up to the outlet header 110 making an angle ($\alpha$) from the horizontal plane (along axis A-A' or B-B') of the auxiliary header 302 and the outlet header 110 in an upward direction. Furthermore (not shown), the auxiliary header 302 may also be configured nonparallel to the outlet header 110 such that the longitudinal axis of the auxiliary header 302 and the outlet header 110 remain nonparallel to each other.

In one or more embodiments, the auxiliary header 302 can be at a distance from the outlet header 110, such that the auxiliary header 302 remains away from the cold air flowing downstream of the microchannel tubes 108 or remains in thermal contact with a warm or hot airflow (return air). As illustrated in FIG. 1E, the auxiliary header 302 can be configured in the housing of the heat exchanger such that the microchannel tubes 108 remain on one side of the outlet header 110 and the auxiliary header 302 remains on another side of the outlet header 110 away from the cold air flowing downstream of the microchannel tubes 108, but remain in thermal contact with the warm or hot airflow. This may facilitate the fluid collected in the auxiliary header 302 to achieve the superheated temperature, thereby making the overall heat exchange process efficient.

Figure 1F:
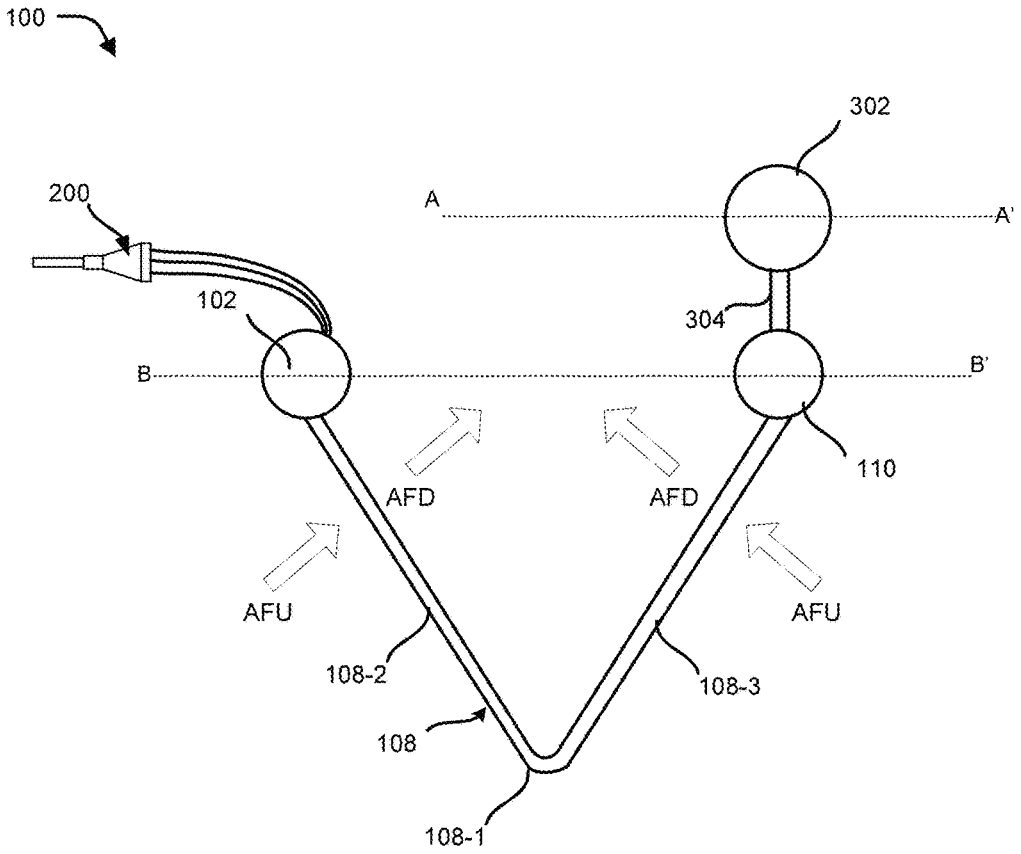
Figure 1G:
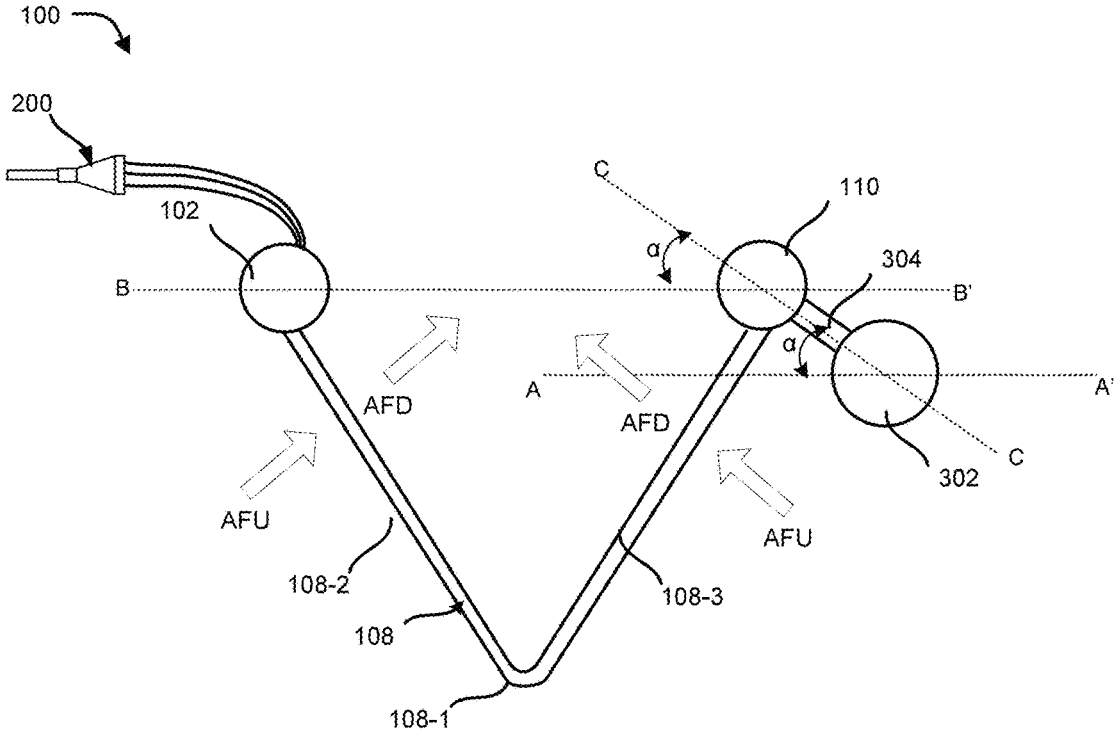
Figure 1H:
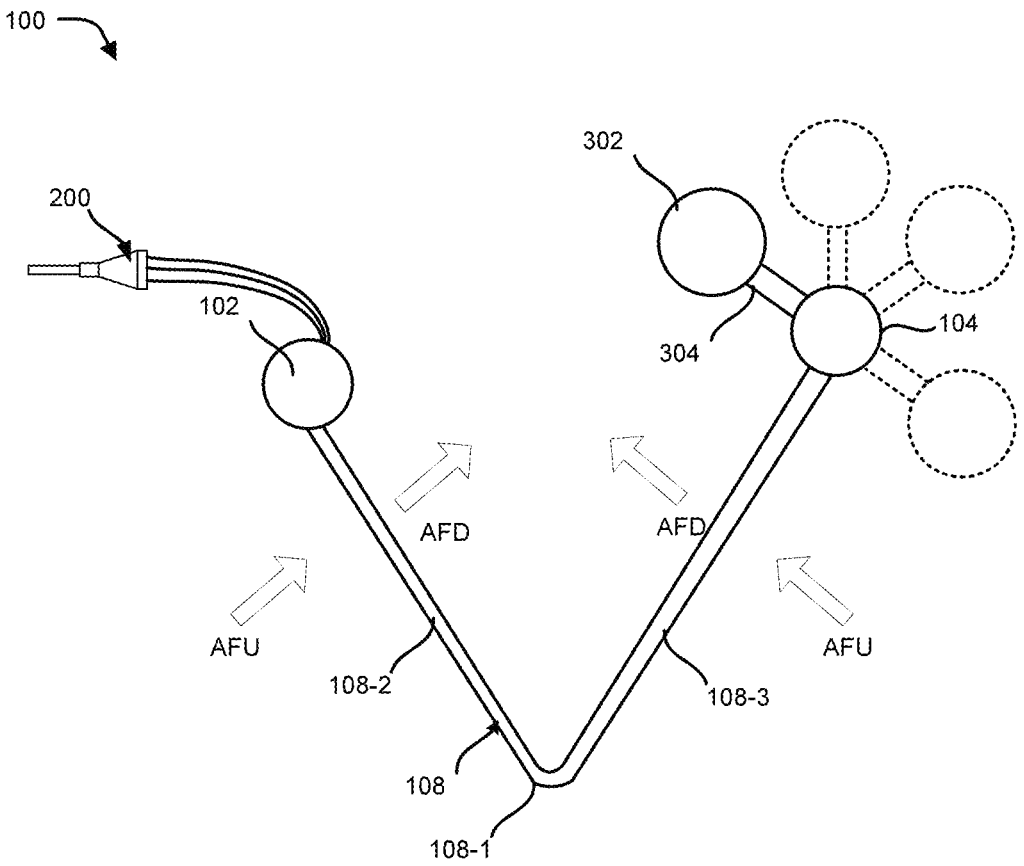
FIG. 1H illustrates an exemplary perspective view of the heat exchanger where the inlet header and the outlet header are at different vertical heights or elevations in accordance with one or more embodiments of the subject disclosure

Further, in one or more embodiments, as shown in FIG. 1F, the auxiliary header 302 may be disposed within the housing of the heat exchanger (an area between the inlet header 102 and outlet header 110, but in proximity to the outlet header 110), which may facilitate efficient packaging of the auxiliary header 302 and keeping the overall heat exchanger compact.

Furthermore, in one or more embodiments, as shown in FIG. 1G, the auxiliary header 302 may also be disposed above the outlet header 110 within the housing of the heat exchanger, which may also facilitate efficient packaging of the auxiliary header 302 and keep the overall heat exchanger or indoor unit compact.

The tube stubs 304 may have a length based on a separation distance to be fixed between the auxiliary header 302 and the outlet header 110. The tube stubs 304 may be configured parallelly to each other and extending between the outer surfaces of the auxiliary header 302 and the outlet header 110, such that the auxiliary header 302 remains at a distance (equal to the length of the tube stub) or height from the outlet header 110. In one or more embodiments, the tube stubs 304 may protrude from an outer surface of the auxiliary header 302 (along axis C-C') and extend up to the outlet header 110 forming an angle ($\alpha$) from the horizontal plane (along axis A-A') of the auxiliary header 302 in a downward direction as shown in FIGS. 1D and 1E, such that the auxiliary header 302 remains at a distance and inclined at the angle ($\alpha$) from the outlet header 110. In other embodiments, as shown in FIG. 1F, the tube stubs 304 may protrude perpendicularly upward from the outer surface of the outlet header 110 (along axis B-B') along a vertically perpendicular axis with respect to the horizontal plane of the outlet header 110 and extend up to the auxiliary header 302 of the auxiliary header 302 in an upward direction, such that the auxiliary header 302 remains vertically above the outlet header 110.

In one or more embodiments, the one or more tube stubs 304 may have a varying diameter along a longitudinal axis of the outlet header 110. For instance, in one or more embodiments, the diameters of the tube stubs 304 connected to the second compartments 114 of the outlet header 110 may increase while moving from the extreme ends of the outlet header 110 towards a middle portion of the outlet header 110. However, in other embodiments, the diameter of the tube stubs 304 may increase or decrease from the first end to the second end of the outlet header 110 or the auxiliary header 302. Further, in other embodiments, each of the tube stubs 304 may also have the same diameter.

Figure 3:
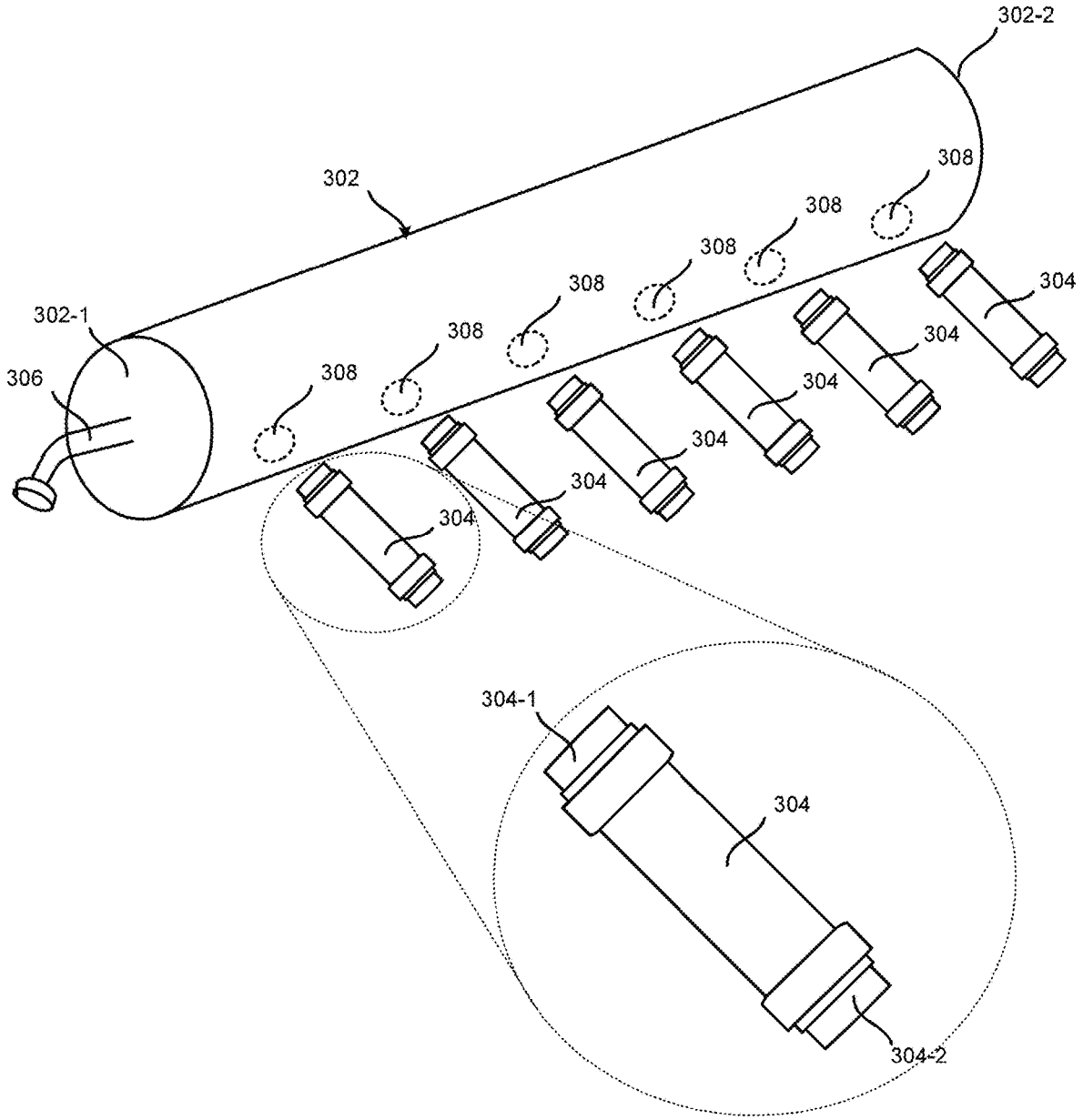
FIG. 3 is an exemplary exploded view of the auxiliary header and the tube stubs of the heat exchanger in accordance with one or more embodiments of the subject disclosure

In one or more embodiments, the auxiliary header 302 and the outlet header 110 may be a hollow member having a cylindrical profile, where the diameter of the auxiliary header 302 may be equal to or more than the diameter of the outlet header 110. The cylindrical surface of the auxiliary header 302 may include a plurality of first slots 308. In addition, the cylindrical surface of the outlet header 110 may also include a plurality of second slots (not shown). Further, as shown in FIG. 3, each of the tube stubs 304 can be a hollow member having a first open end 304-1 and a second open end 304-2. The first slots 308 of the auxiliary header 302 can be adapted to accommodate and attach the first end 304-1 of one of the tube stubs 304 and each of the second slots of the outlet header 110 can be adapted to accommodate and attach the second end 304-2 of the corresponding tube stubs 304. The first and second ends 304-1, 304-2 of each tube stub 304 can be configured with one of the first slots of the auxiliary header 302 and one of the second slots of the outlet header 110, respectively, such that the tube stubs 304 extend parallelly to each other (between the auxiliary header 302 and the outlet header 110), with a gap between two adjacent tube stubs 304.

In one or more embodiments, the size of the opening at the first end 304-1 of tube stubs 304 (connected to the auxiliary header 302) may be kept bigger than the opening at the second end 304-2 such that each of the tube stubs 304 may further facilitate in even/uniform collection of the refrigerant (fluid) from the second compartments 114 of the outlet header 110 while restricting the reverse flow of the collected fluid towards the outlet header 110. Further, one of the ends 302-1 of the auxiliary header 302 may be configured to allow the removal of the collected fluid from the auxiliary header back to the refrigerant circuit via suction tube 306. Referring to FIGS. 1A to 1C, and 3, in one or more embodiments, the heat exchanger 100 can include a fluid collector device or a suction tube 306 fluidically connected to one end 302-1 of the auxiliary header 302. The fluid collector device or suction tube 306 can be configured to receive and collect the fluid from the auxiliary header 302.

It should be obvious to a person skilled in the art that while various embodiments of this subject disclosure have been elaborated for the headers 102, 110 having a specific number of compartments and the auxiliary header 302 having a specific number of tube stubs 304 for the sake of simplicity and better explanation purpose, however, the teachings of this subject disclosure are equally applicable for the headers 102, 110 having a different number of compartments and the auxiliary header 302 having a different number of tube stubs 304, and all such embodiments are well within the scope of this subject disclosure.

Thus, this invention overcomes the drawbacks, limitations, and shortcomings associated with existing heat exchangers by providing an improved, and effective solution that helps the heat exchanger achieve more uniform distribution of the fluid phases across all the microchannel tubes 108, thereby enhancing the overall thermal performance of the heat exchanger.

While the subject disclosure has been described with reference to exemplary embodiments, it will be understood by those skilled in the art that various changes may be made and equivalents may be substituted for elements thereof without departing from the scope of the subject disclosure as defined by the appended claims. Modifications may be made to adopt a particular situation or material to the teachings of the subject disclosure without departing from the scope thereof. Therefore, it is intended that the subject disclosure not be limited to the particular embodiment disclosed, but that the subject disclosure includes all embodiments falling within the scope of the subject disclosure as defined by the appended claims.

In interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

The invention claimed is:

1. A heat exchanger comprising:

a plurality of microchannel tubes extending between and in fluidic connection with an inlet header and an outlet header of the heat exchanger;

an external distributor that comprises an inlet port and a plurality of outlet ports, wherein a plurality of feeder pipes is configured between the outlet ports of the first distributor and positioned along a length of the inlet header to enable flow of volumes of fluid from the external distributor into the inlet header; and an auxiliary header fluidically coupled to the outlet header using one or more tube stubs, the auxiliary header configured at a distance from the outlet header with the one or more tube stubs protruding from the outlet header and extending up to the auxiliary header forming an angle from a horizontal plane of the outlet header, wherein the auxiliary header is configured to receive and collect the fluid received in the outlet header.

2. The heat exchanger of claim 1, wherein the inlet header and the outlet header are positioned at the same vertical height and the plurality of microchannel tubes includes a bend forming a V-coil configuration having a first leg on a first side of the bend and a second leg on a second side of the bend, wherein the first leg and the second leg define a mixing area therebetween for mixing an incoming airflow coming from a bottom side of the plurality of microchannel tubes.

3. The heat exchanger of claim 1, wherein the inlet header and the outlet header are positioned at different heights and the plurality of microchannel tubes includes a bend forming a V-coil configuration having a first leg on a first side of the bend and a second leg on a second side of the bend, wherein the first leg and the second leg have different lengths and define a mixing area therebetween for mixing of an incoming airflow coming from a bottom side of the plurality of microchannel tubes.

4. The heat exchanger of claim 1, wherein the inlet header is a hollow member having one or more first compartments separated by one or more first walls, and wherein the plurality of feeder pipes is configured between the outlet ports of the first distributor and the first compartments of the inlet header, such that each of the first compartments remains fluidically connected to at least one of the outlet ports of the external distributor by at least one of the feeder pipes to enable flow of the volumes of fluid from the external distributor into the one or more first compartments.

5. The heat exchanger of claim 1, wherein the outlet header is a hollow member having one or more second compartments separated by one or more second walls, and wherein a first end of each of the tube stubs is fluidically connected to at least one of the second compartments of the outlet header and a second end of the corresponding tube is fluidically connected to the auxiliary header.

6. The heat exchanger of claim 1, wherein the outlet ports of the first distributor are non-uniform in size such that the volumes of the fluid is provided in the first compartments of the inlet header.

7. The heat exchanger of claim 6, wherein the feeder pipes have non-uniform diameters and lengths such that a target pressure drop is achieved in the feeder pipes and the volumes of the fluid is supplied in the first compartments of the inlet header.

8. The heat exchanger of claim 6, wherein diameters and lengths of the feeder pipes connected to the one or more first compartments decrease while moving from extreme ends of the inlet header towards a middle portion of the inlet header.

9. The heat exchanger of claim 1, wherein the feeder pipes associated with each of the first compartments are fluidically connected to the corresponding first compartment, such that the fluid received from the external distributor impinges on an interior surface of the corresponding first compartment which is in thermal contact with an incoming airflow upstream of the plurality of microchannel tubes.

10. The heat exchanger of claim 1, wherein an outlet end of the feeder pipes being fluidically connected to the inlet header comprises an orifice of a shape to create and supply a homogenous mixture of the fluid into the first compartments of the inlet header.

11. The heat exchanger of claim 1, wherein the auxiliary header is oriented parallel to the outlet header, wherein each of the tube stubs is a hollow member whose longitudinal axis is oriented perpendicular to a longitudinal axis of the outlet header, such the plurality of tube stubs remains parallel to each other with a gap therebetween.

12. The heat exchanger of claim 1, wherein the one or more tube stubs have a varying diameter along a longitudinal axis of the first header.

13. The heat exchanger of claim 1, wherein diameters of the one or more tube stubs connected to the one or more second compartments increase while moving from extreme ends of the outlet header towards a middle portion of the outlet header.

14. The heat exchanger of claim 1, wherein the auxiliary header is at a distance from the outlet header, such that the auxiliary header remains away from the air flowing downstream of the plurality of microchannel tubes.

15. The heat exchanger of claim 1, wherein the auxiliary header is at a distance from the outlet header such that the auxiliary header remains in thermal contact with the warm or hot return airflow.

16. The heat exchanger of claim 1, wherein the auxiliary header is configured such that the plurality of microchannel tubes remains on one side of the outlet header and the auxiliary header remains on another side of the outlet header away from the air flowing downstream of the plurality of microchannel tubes.

17. The heat exchanger of claim 1, wherein the one or more tube stubs protrudes from the outlet header and extends up to the auxiliary header at an angle from the horizontal plane of the outlet header in an upward direction such that the microchannel tubes remain on one side of the outlet header and the auxiliary header remains on another side of the outlet header away from the air flowing downstream of the microchannel tubes.

18. The heat exchanger of claim 1, wherein the one or more tube stubs protrudes from the outlet header and extends up to the auxiliary header at an angle from the horizontal plane of the outlet header in a downward direction such that the microchannel tubes remain on one side of the outlet header and the auxiliary header remains on another side of the outlet header away from the air flowing downstream of the microchannel tubes.

19. The heat exchanger of claim 1, wherein the one or more tube stubs protrudes from the outlet header and extends up to the auxiliary header at an angle from the horizontal plane of the outlet header in an upward direction such that the auxiliary header remains disposed in a housing of the heat exchanger.

20. The heat exchanger of claim 1, wherein the one or more tube stubs protrudes vertically upward from the outlet header and extends up to the auxiliary header such that the auxiliary header remains above the outlet header within a housing of the heat exchanger.

* * * * *